US007757434B1

(12) United States Patent
Naclerio

(10) Patent No.: US 7,757,434 B1
(45) Date of Patent: Jul. 20, 2010

(54) TREE STAND WITH INTEGRAL IRRIGATION MEANS

(76) Inventor: Frederick Naclerio, 1863 Adventure Pl., North Lauderdale, FL (US) 33068

( * ) Notice: Subject to any disclaimer, the term of this patent is extended or adjusted under 35 U.S.C. 154(b) by 0 days.

(21) Appl. No.: 12/291,722

(22) Filed: Nov. 13, 2008

Related U.S. Application Data

(60) Provisional application No. 61/002,525, filed on Nov. 13, 2007.

(51) Int. Cl.
*A47G 33/12* (2006.01)

(52) U.S. Cl. ..... 47/40.5

(58) Field of Classification Search ..... 47/40.5
See application file for complete search history.

(56) References Cited

U.S. PATENT DOCUMENTS

| | | | | | |
|---|---|---|---|---|---|
| 2,938,304 | A | * | 5/1960 | Thomas et al. | 47/57.5 |
| 3,137,969 | A | * | 6/1964 | Sokol | 47/57.5 |
| 3,715,095 | A | * | 2/1973 | Drablowski | 47/40.5 |
| 5,111,611 | A | * | 5/1992 | Elder | 47/40.5 |
| 5,349,997 | A | | 9/1994 | Real | |
| 5,410,839 | A | | 5/1995 | Granger | |
| 5,473,838 | A | | 12/1995 | Denbigh | |
| 5,535,547 | A | * | 7/1996 | Brunengo | 47/40.5 |
| 5,661,926 | A | | 9/1997 | Granger | |
| 5,791,083 | A | * | 8/1998 | Giangrossi | 47/40.5 |
| 5,938,168 | A | * | 8/1999 | Adams | 248/523 |
| 5,987,813 | A | * | 11/1999 | Lasko | 47/40.5 |
| D417,596 | S | | 12/1999 | Crowder | |
| D436,006 | S | | 1/2001 | DeMarino | |
| 6,568,127 | B1 | * | 5/2003 | Kalman et al. | 47/40.5 |
| D483,234 | S | * | 12/2003 | Hansen | D8/1 |
| 2004/0083646 | A1 | * | 5/2004 | Bielen | 47/40.5 |
| 2004/0261854 | A1 | * | 12/2004 | Bolster | 137/434 |

* cited by examiner

*Primary Examiner*—Francis T Palo
(74) *Attorney, Agent, or Firm*—Montgomery Patent and Design; Robert C. Montgomery; Joseph T. Yaksich

(57) ABSTRACT

An apparatus for securing and irrigating a live tree such as a Christmas tree is herein disclosed. The apparatus incorporates a tree ornament that has an internal water reservoir which is fluidly connected to a tree base stand. Besides holding the tree securely erect, the base stand provides the primary water reservoir for the tree. The ornament is affixed to the tree in a conventional manner with a small diameter hose extending from the ornament to the base stand reservoir. The base reservoir has a float valve that allows water to drain into the base from the ornament while controlling a maximum water level. The apparatus is particularly useful for trees that are difficult to reach, or for people who have difficulty in bending over, kneeling, or crawling under a tree.

16 Claims, 4 Drawing Sheets

TREE STAND WITH INTEGRAL IRRIGATION MEANS

RELATED APPLICATIONS

The present invention was first described in and claims the benefit of U.S. Provisional Patent Application No. 61/002,525 filed on Nov. 13, 2007, the entire disclosures of which are incorporated herein by reference.

FIELD OF THE INVENTION

This invention relates to a safe and effective method and apparatus for obtaining a temperature of an animal without excessive handling, particularly a horse, comprising a temperature obtaining means embedded within a bit and a digital display for displaying the obtained temperature.

BACKGROUND OF THE INVENTION

Many people bring cut evergreen trees into their home to use as Christmas trees during the holiday season, which require frequent watering. Often, watering is forgotten and the tree will begin to dry out. Watering after this occurs does little or no good. This creates a fire hazard as any ignition source will turn the dry tree into an inferno. Another cause of infrequent watering is that it is somewhat difficult to do, as it requires bending over, kneeling down, crawling and the like, which is an inconvenience for those with physical limitations such as the elderly or physically disabled. Accordingly, there is a need for a means by which Christmas trees can be ensured an adequate amount of water that is easily replenished without the difficulties as described above. The development of the system herein described fulfills this need.

There have been attempts to provide self-watering systems for live cut trees. U.S. Pat. No. D 483,234 issued to Hansen discloses a tree watering ornament that appears to comprise a hinged open to an ornament that is attached to a limb and a tube component exiting the ornament. Unfortunately, this design patent does not appear to be similar in appearance to the disclosed system nor does it appear to disclose a tree stand with an integral irrigation means control by a ball valve mechanism.

U.S. Pat. No. 6,347,479 issued to Greenberg et al. discloses a Christmas tree watering apparatus that comprises a funnel, an upspout, two (2) lengths of pipe, and a downspout, all supported by a stand which rests on a floor. Unfortunately, this patent does not appear to comprise a decorative ornament assembly that is connected by tubing to a tree stand base assembly and that possesses a ball valve mechanism to regulate the flow of water to the base to prevent overfilling of the base reservoir.

U.S. Pat. No. D 436,006 issued to DeMarino discloses an ornamental Christmas tree watering device that appears to take the shape of a cane. Unfortunately, this design patent does not appear to be similar in appearance to the disclosed system, nor does it appear to disclose a tree stand with an integral irrigation system comprising an ornament assembly into which water may be added that is in fluid communication with the tree stand.

U.S. Pat. No. D 417,596 issued to Crowder discloses a Christmas tree watering device that comprises a funnel like structure that appears to attach to a tree limb. Unfortunately, this design patent does not appear to be similar to the disclosed system, nor does it appear to be a tree stand with an integral irrigation means.

U.S. Pat. No. 5,661,926 issued to Granger discloses a funnel like watering device for a Christmas tree with an indicating mechanism attached at the top of the funnel to indicate the water level in the tree stand. Unfortunately, this patent does not appear to disclose a decorative ornament assembly that accepts and conducts water through attached tubing to a tree stand water reservoir and that utilizes a ball valve mechanism to regulate the flow of water into the stand reservoir.

U.S. Pat. No. 5,473,838 issued to Denbigh discloses a Christmas tree watering device that appears to comprise a funnel with a decorative element which attaches to a tree limb. Unfortunately, this patent does not appear to comprise a decorative ornament assembly that is connected by tubing to a tree stand base assembly and that possesses a ball valve mechanism to regulate the flow of water to the base to prevent overfilling of the base reservoir.

U.S. Pat. No. 5,410,839 issued to Granger discloses a Christmas tree watering funnel with a float that activates an indicating light when the water level in the tree stand is depleted. Unfortunately, this patent does not appear to disclose a tree stand with an integral irrigation system comprising an ornament assembly, tubing, a base stand assembly and a valve to regulate water flow that prevents overfilling of a tree stand.

U.S. Pat. No. 5,349,997 issued to Rial discloses a system for watering a tree comprising an angular funnel attached to tubing that connects to a tree stand base. Unfortunately, this patent does not appear to comprise a decorative ornament assembly that is connected by tubing to a tree stand base assembly and that possesses a ball valve mechanism to regulate the flow of water to the base to prevent overfilling of the base reservoir.

SUMMARY OF THE INVENTION

In light of the disadvantages as previously described in the prior art, it is apparent that there is a need for a tree stand with integral irrigation means which provides a securing and irrigating means to a live tree.

An object of the tree stand with integral irrigation means comprises a Christmas tree-style ornament-shaped reservoir with a flexible tube extending downwardly to transport a flow of water to a float valve assembly located within a base stand reservoir.

Another object of the tree stand with integral irrigation means provides control of a water level in a base stand reservoir, thereby avoiding overflowing.

A further object of the tree stand with integral irrigation means provides an irrigation means particularly useful for trees which are difficult to reach, or for people who have difficulty in bending over, kneeling, or crawling under a tree.

Still another object of the tree stand with integral irrigation means provides a variety of decorative colors and patterns suitable to holiday themes as well as surrounding décor.

Still a further object of the tree stand with integral irrigation means comprises various indicia similar to conventional ornaments depicting holiday symbols, artwork, and other appropriate decorative designs thereupon outer surfaces.

Yet another object of the tree stand with integral irrigation means comprises a manufacture using durable corrosion resistant metal and plastic materials.

Yet a further aspect of the tree stand with integral irrigation means comprises a valve assembly that is designed to allow water to drain downwardly into the base stand reservoir in a controlled manner without overflowing.

Yet still another aspect of the tree stand with integral irrigation means provides an ornament hook to provide an attachment means to secure the ornament assembly to a foliage portion of the tree in a normal manner.

An aspect of the tree stand with integral irrigation means comprises an ornament assembly further comprising an ornament-shaped reservoir, a top located reservoir orifice, an ornament lid, an ornament hook and an ornament hose fitting.

A further aspect of the tree stand with integral irrigation means comprises an ornament reservoir comprising a generally spherical or cylindrical shape that is in fluid communication with a tree base stand assembly via flexible tubing. The reservoir orifice provides a water receiving means being hung upon said tree at a convenient location on a side portion of said tree using an ornament hook.

Still another aspect of the tree stand with integral irrigation means comprises an ornament lid comprising a cylindrical or spherical profile providing an aesthetic top enclosure to said ornament assembly. The ornament lid provides a hinging attachment means to the ornament reservoir by an integrally molded ornament lid hinge.

Still a further aspect of the tree stand with integral irrigation means comprises an ornament hose fitting located along a bottom surface of the ornament reservoir and further comprising a water-tight cylindrical male fitting providing a fluid attachment being inserted into the flexible tubing portion.

Yet a further aspect of the tree stand with integral irrigation means comprises flexible tubing that provides an attachment means to a valve assembly at a lower end, routed internally to the tree, and secured vertically to a trunk portion of said tree via a plurality of common tie-wrap fasteners. The tubing provides a conduit means to a flow of water from said ornament reservoir to the base stand assembly.

Still another aspect of the tree stand with integral irrigation means comprises a base stand assembly comprising expected features and fixtures found on conventional tree and further comprising an enlarged oval or pear-shaped base stand reservoir being large enough to receive both a trunk portion of the tree and the valve assembly.

Yet another aspect of the tree stand with integral irrigation means comprises a valve assembly further comprising a lid, a standpipe, a float, and a valve housing. The lid extends horizontally around the standpipe portion to provide a partial cover and an attachment means to the base stand assembly. The standpipe provides a tubular attachment means to the aforementioned flexible tubing at a top opening portion. The valve housing provides a float-valve function via an internal spherical float.

Still yet another aspect of the tree stand with integral irrigation means comprises footpads comprising three (3) outwardly angled leg structures further comprising integral circular horizontal feet designed to establish a secure platform and providing vertical stability to the apparatus.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
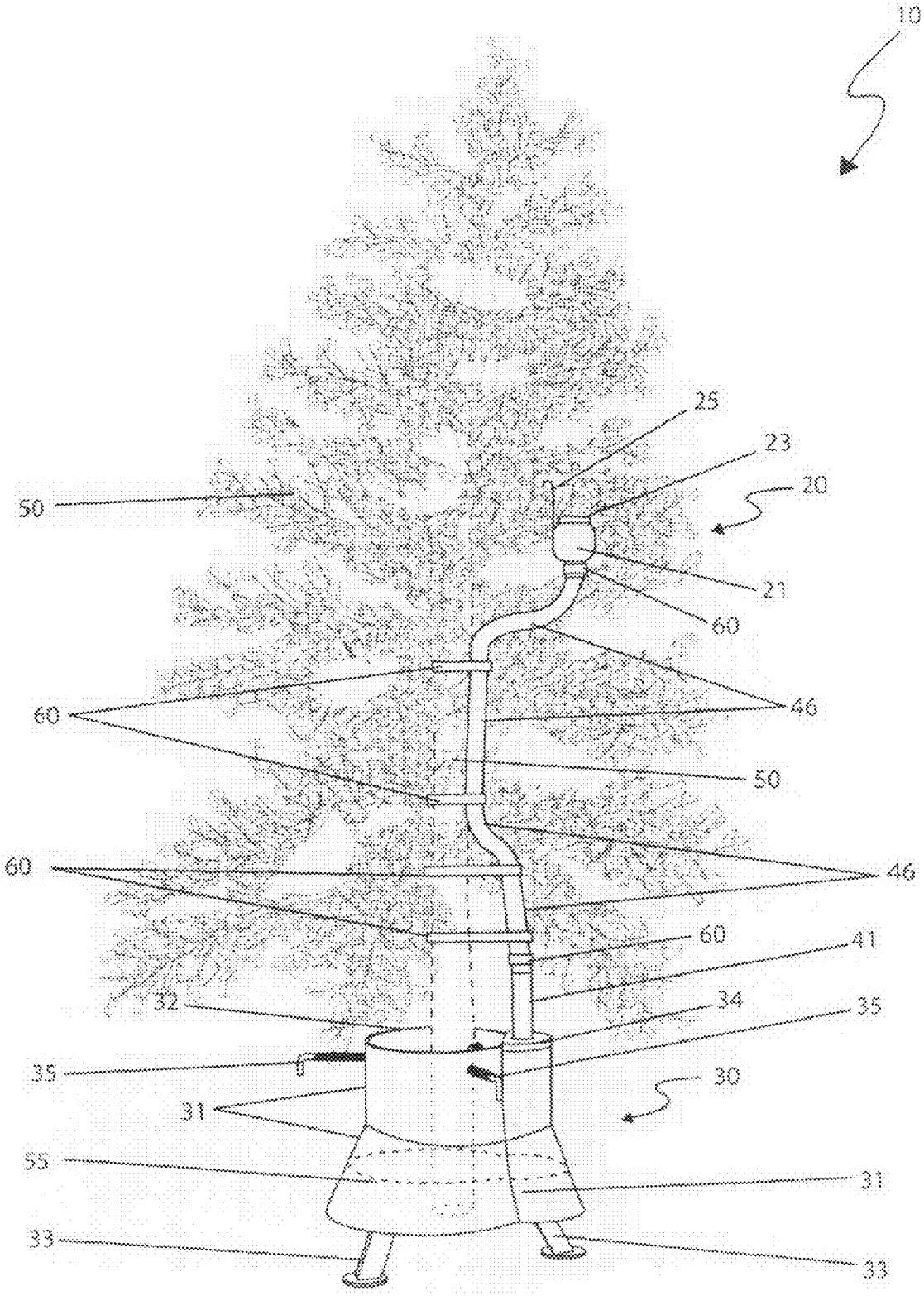
FIG. 1 is an environmental view of a tree stand with integral irrigation means 10, according to a preferred embodiment of the present invention.

10 tree stand with integral irrigation means
20 ornament assembly
21 ornament reservoir
22 ornament orifice
23 ornament lid
24 ornament lid hinge
25 ornament hook
26 ornament hose fitting
28 indicia
30 base stand assembly
31 base stand reservoir
32 base stand orifice
33 footpad
34 reservoir lid
35 clamp bolt
37 spike anchor
40 valve assembly
41 standpipe
42 valve housing
43 float
46 tubing
50 tree
55 water level
60 tie-wrap.

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a tree stand with integral irrigation means (herein described as the "apparatus") 10, which provides a securing and irrigating means thereto a live tree 50 such as a Christmas tree. The apparatus 10 comprises a tree ornament-shaped reservoir 21 with a flexible tube 46 extending downwardly therefrom to transport a flow of water thereto a float valve assembly 40 located within a base stand reservoir 31. The apparatus 10 provides control of a water level 55 therein a base stand reservoir 31, thereby avoiding overflowing. The apparatus 10 is particularly useful for trees which are difficult to reach, or for people who have difficulty in bending over, kneeling, or crawling under a tree 50.

Figure 2:
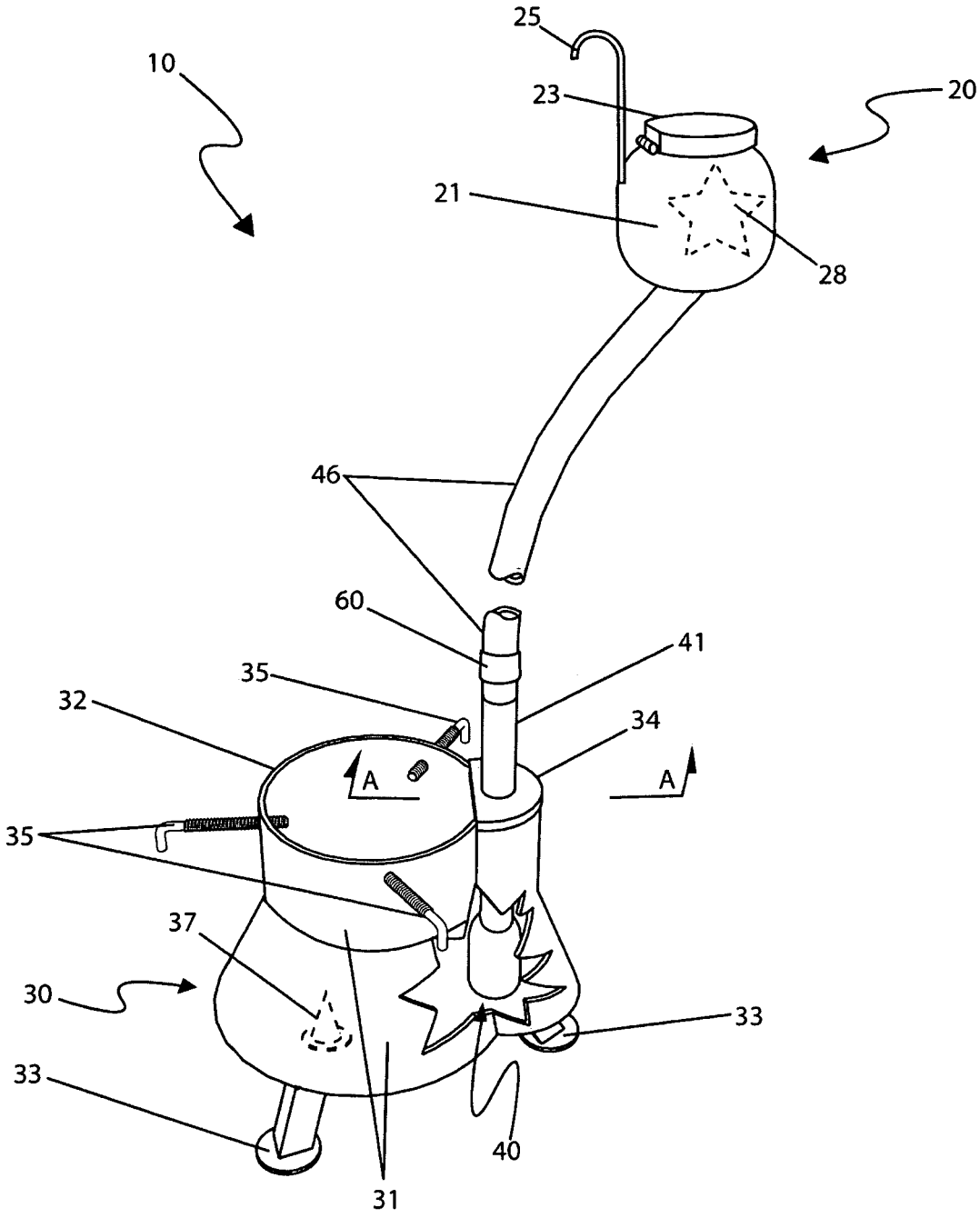
FIG. 2 is a perspective view of a tree stand with integral irrigation means 10 showing a cut-away portion of a base stand assembly 30, according to a preferred embodiment of the present invention.

Referring now to FIGS. 1 and 2, environmental and perspective views of the apparatus 10, respectively, according to the preferred embodiment of the present invention, are disclosed. The apparatus 10 provides a tree irrigation means comprising an ornament assembly 20 further comprising an ornament-shaped reservoir 21 with a top located reservoir orifice 22. Said reservoir orifice 22 provides a water receiving means being hung thereupon said tree 50 at a convenient location on a side portion of said tree 50 using an ornament hook 25 in similar fashion as a conventional bulb-type tree ornament. The ornament reservoir 21 comprises a generally spherical or cylindrical shape approximately six (6) inches in diameter being in fluid communication therewith a tree base stand assembly 30 via flexible tubing 46. The tubing 46 is routed internally thereto the tree 50 and secured vertically thereto a trunk portion of said tree 50 via a plurality of common tie-wrap fasteners 60. The flexible tubing 46 provides an attachment means thereto a valve assembly 40 at a lower end thereof via a tie-wrap 60 (see FIG. 4). The base stand assembly 30 comprises expected features and fixtures found on conventional tree stands such as three (3) triangulated clamp bolts 35, a plurality of floor-contacting footpads 33, a water-bearing base stand reservoir 31, and a center stabilizing spike anchor 37 protrusion to hold the tree 50 securely erect. The base stand assembly 30 further comprises an enlarged oval or pear-shaped base stand reservoir 31 being large enough to receive both a trunk portion of the tree 50 and the valve assembly 40. The valve assembly 40 is designed to allow water to drain downwardly thereinto the base stand reservoir 31 in a controlled manner without overflowing (see FIG. 4). The footpads 33 comprise preferably three (3) outwardly angled leg structures similar to conventional tree stands comprising integral circular horizontal feet designed to establish a secure platform, thereby providing vertical stability thereto the apparatus 10 when placed upon a flat surface. The various components of the apparatus 10 are envisioned to be made using durable corrosion resistant metal and plastic materials. It is also envisioned that the apparatus 10 may be introduced in a variety of decorative colors and patterns suitable to holiday themes as well as surrounding décor. Furthermore, the ornament assembly 20 is envisioned to comprise various indicia 28 similar thereto conventional ornaments depicting holiday symbols, artwork, and other appropriate decorative designs thereupon outer surfaces.

Figure 3:
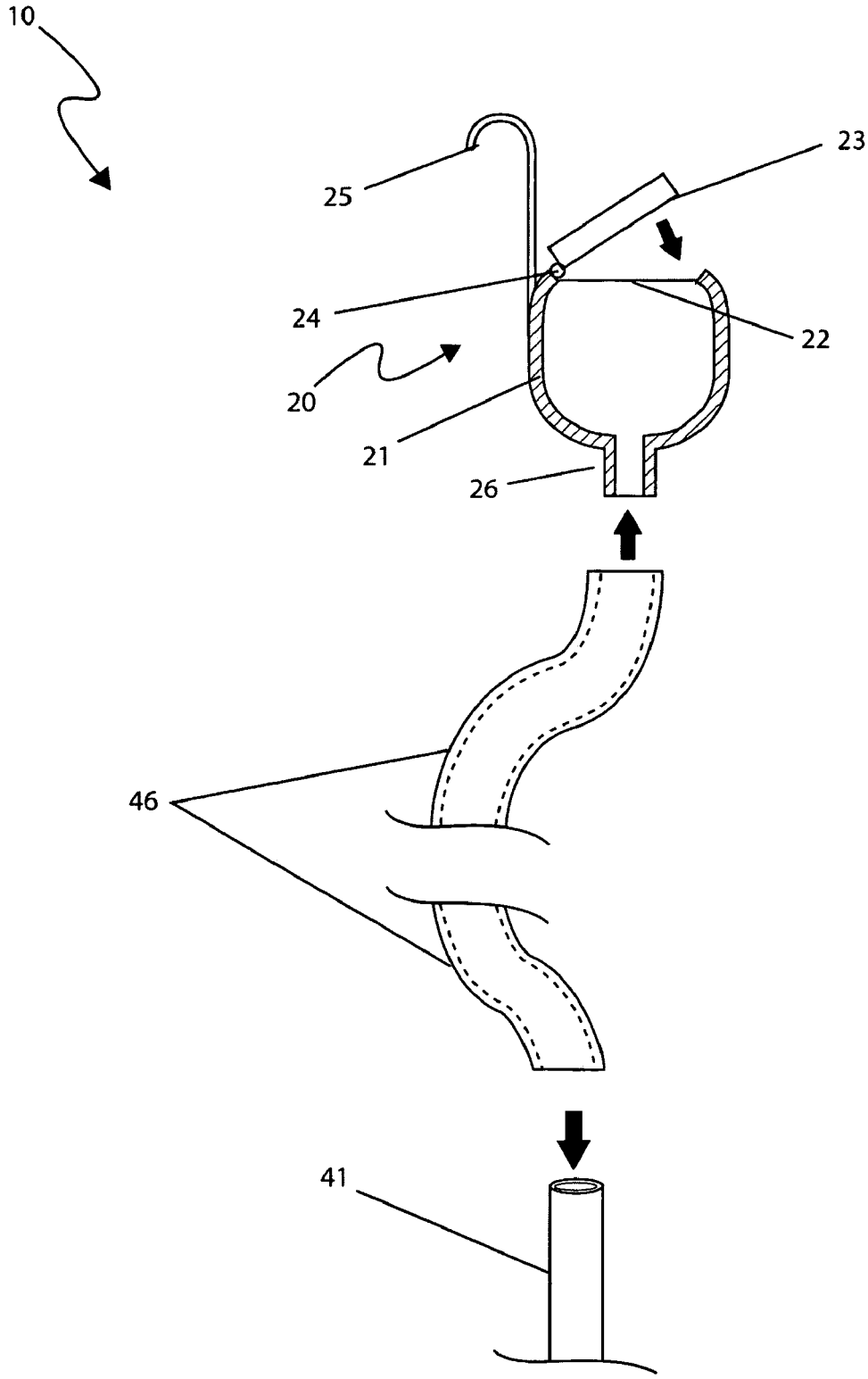
FIG. 3 is a break-away view of an ornament assembly portion 20 of the tree stand with integral irrigation means 10, according to a preferred embodiment of the present invention; and, FIG. 4 is a section view taken along section line A-A (see FIG. 2) of the tree stand with integral irrigation means 10, according to a preferred embodiment of the present invention.

Referring now to FIG. 3, a break-away view of an ornament assembly portion 20 of the apparatus 10, according to a preferred embodiment of the present invention, is disclosed. The ornament assembly 20 comprises a decorative plastic assembly using polypropylene, polyethylene, or similar materials being fabricated using a plastic injection molding process being common in the industry. The ornament assembly 20 further comprises an ornament lid 23, an ornament hook 25, and an ornament hose fitting 26. The ornament lid 23 comprises a cylindrical or spherical profile providing an aesthetic top enclosure thereto said ornament assembly 20. The ornament lid 23 provides a hinging attachment means thereto said ornament reservoir 21 via an integrally molded ornament lid hinge 24 along a rear edge of the aforementioned ornament orifice 22. Adjacent thereto said ornament lid hinge 24 is an ornament hook 25 comprising a hook-shaped appendage being integral thereto the ornament reservoir 21. Said ornament hook 25 provides an attachment means to secure the ornament assembly 20 thereto a foliage portion of the tree 50 in a normal manner. The ornament hose fitting 26 is located along a bottom surface of the ornament reservoir 21 and comprises a water-tight cylindrical male fitting providing a fluid attachment being inserted thereinto the flexible tubing portion 46. The tubing 46 provides a conduit means thereto a flow of water therefrom said ornament reservoir 21 thereto the base stand assembly 30. The tubing 46 is approximately one-half (½) inch in diameter and approximately three (3) to five (5) feet long and is envisioned to be made using flexible transparent, translucent, or opaque materials such as, but not limited to: polyethylene, urethane, Tygon®, rubber, or the like.

Figure 4:
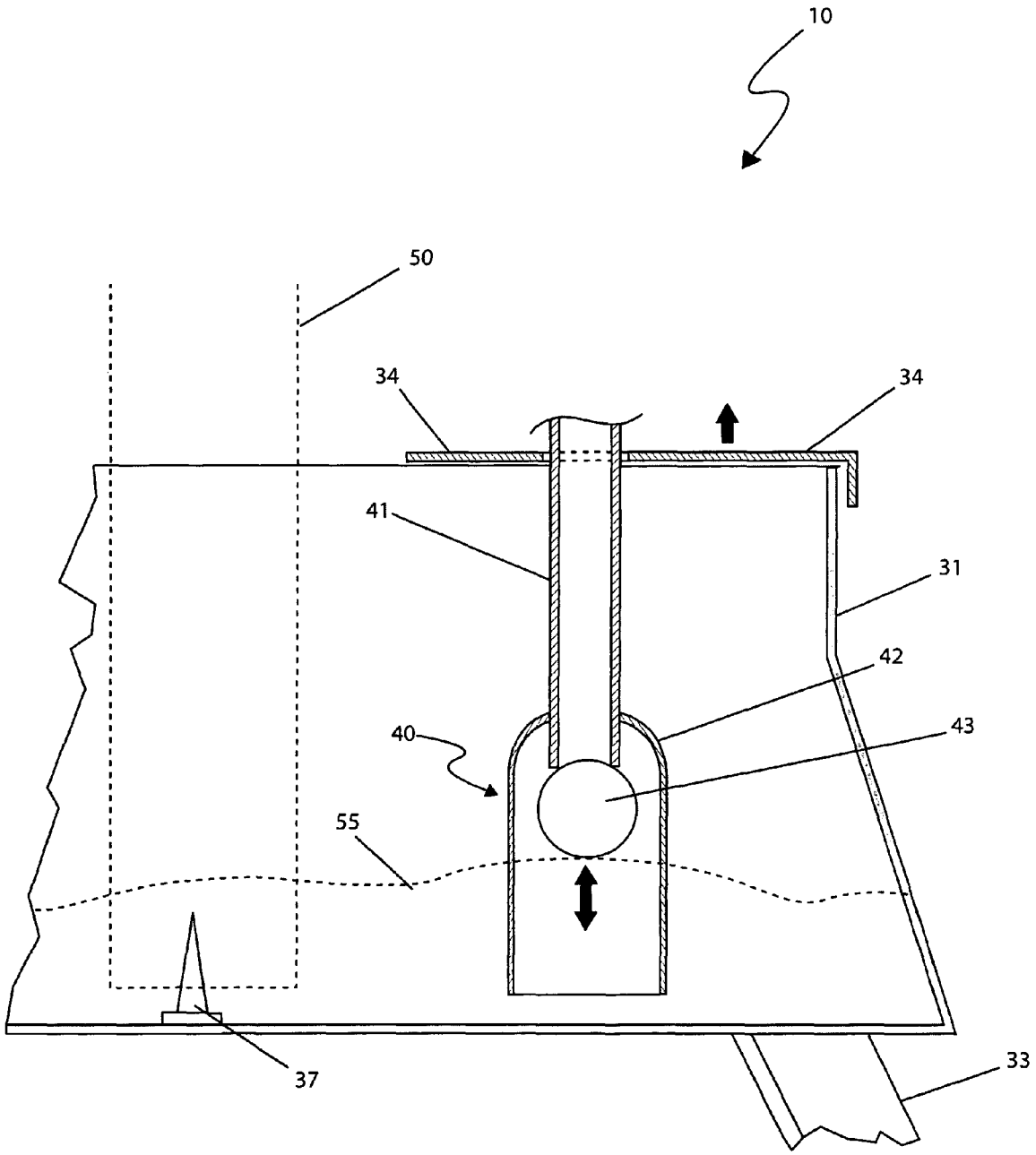

Referring now to FIG. 4, a section view taken along section line A-A (see FIG. 2) of the tree stand with integral irrigation means 10, according to a preferred embodiment of the present invention, is disclosed. The base stand assembly 30 further comprises an enlarged base stand reservoir 31 being large enough to receive both a trunk portion of the tree 50 and the valve assembly 40. The valve assembly 40 further comprises a lid 34, a standpipe 41, a float 43, and a valve housing 42. The lid 34 extends horizontally being inserted therearound the standpipe portion 41 to provide a partial cover and an attachment means thereto the base stand assembly 30 via downwardly angled outer edges being formed at a right angle and overlapping an upper perimeter edge of said base stand assembly 30. The standpipe 41 provides a tubular attachment means thereto the aforementioned flexible tubing 46 via a common tie-wrap 60 thereat a top opening portion thereof (see FIGS. 1 and 2). The standpipe 41 extends downwardly thereinto the base stand reservoir 31 providing a permanent annular attachment thereto the bell-shaped valve housing 42. The valve housing 42 provides a float-valve function via an internal spherical float 43. As water drains downwardly thereinto the base stand assembly 30 from the ornament reservoir 21, said float 42 raises due to a buoyant force, thereby seating said valve housing 42 thereagainst a bottom opening portion of the standpipe 41 to stop the water flow without allowing said water level 55 to overflow the base stand reservoir 31.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: placing the apparatus 10 upon a household floor or other flat surface; adjusting the plurality clamp bolts 35 outwardly by turning in a counter-clockwise direction, thereby maximizing a top open area on a base stand reservoir; inserting a tree 50 such as a Christmas tree thereinto the base stand orifice 31 therebetween the clamp bolts 35 and being secured via the spike anchor 37; tightening the clamp bolts 35 in alternating succession until the tree 50 is erect and stationary in a conventional manner; routing the flexible tubing 46 into a foliage portion of the tree 50 starting at an external location where an eventual position for the ornament reservoir 21 is desired; routing said flexible tubing 46 such that a plain end of said flexible tubing 46 is directed inwardly toward the tree trunk 50 thereat a downward slope, thereby assuring proper drainage; attaching said tubing 46 thereto said tree 50 using a plurality of tie-wraps 60 as needed; attaching the tubing 46 thereto a top opening portion of the standpipe 41 utilizing a secure friction-fit thereto; attaching the tubing 46 thereto the ornament hose fitting portion 26 of the ornament assembly 20 utilizing a secure friction-fit thereto; affixing the ornament assembly 20 securely thereto one (1) or more external branches of the tree 50 using the ornament hook 25; pouring a volume of water thereinto the apparatus 10 by lifting the ornament lid 23 and pouring water into the ornament orifice 22; continuing to add water until the water level 55 therein the base stand reservoir 31 forces the float portion 43 of the valve assembly 40 to seal off the flow of water into said base stand reservoir 31; pouring and adding water therein the ornament reservoir 21 periodically as required; removing the apparatus 10 after use therefrom the tree 50 by cutting and removing the tie-wraps 60; disconnecting and removing the flexible hose 46; storing the apparatus 10 until again needed; discarding the tree 50 in a normal manner; and, benefiting from the convenience and ease of providing a continuous water supply thereto one's tree 50 using the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A tree stand comprising an irrigation means and a securing means thereto a tree, further comprising:

an ornament reservoir removably attachable thereto a upper portion of a tree;

flexible tubing in fluid communication therewith said ornament reservoir;

a float valve assembly in fluid communication therewith said flexible tube; and, a base stand reservoir in fluid communication therewith said float valve assembly and housing said float valve assembly;

wherein said base stand reservoir provides a securing means thereto said tree;

wherein said irrigation means provides an access of water thereto said tree;

wherein said ornament reservoir collects an amount of water and directs it therethrough said flexible tubing thereto said base stand reservoir;

wherein said float valve assembly provides a control of a water level to prevent overflowing; and, wherein said irrigation means is particularly useful for users who have difficulty reaching said tree;

wherein said float valve assembly further comprises a valve housing comprising a float valve function via an internal float in fluid communication therewith said base stand reservoir;

a standpipe extending vertically therefrom said valve housing and in fluid communication therewith and attachable thereto said flexible tubing and said internal float valve; and, a valve assembly portion lid removably attachable thereto an upper perimeter edge thereof said valve assembly portion thereof said base stand reservoir to provide a partial cover and a lid attachment means therefore;

wherein said valve housing has an inverted U-shape provided with vertically opposed top and bottom openings respectively, said standpipe having an open bottom end intermediately positioned between said top and bottom openings of said valve housing, said internal float valve being upwardly urged against said open bottom end of said standpipe when a water level rises within said valve housing;

wherein said internal float valve provides said control for said water level;

wherein said valve assembly portion lid overlaps said upper perimeter edge thereof said valve assembly portion;

wherein said valve assembly portion lid permits the passage thereof said standpipe;

wherein said valve assembly portion lid provides access thereto said float valve assembly.

2. The tree stand of claim 1, wherein said ornament reservoir further comprises:

an ornament body comprising an ornament interior;

a top located reservoir orifice in fluid communication therewith a top portion of said ornament interior;

an ornament lid hingedly attached thereto said ornament body therewith an ornament lid hinge at a rear top surface of said ornament body and providing access thereto said ornament interior;

a hanging means located adjacent thereto said ornament lid hinge; and, an ornament hose fitting in fluid communication therewith a bottom portion of said ornament interior and located along a bottom surface of said ornament body, comprising an upper attachment means thereto said flexible hose;

wherein said hanging means provides a tree attachment means to secure said ornament reservoir thereto a foliage portion of said tree.

3. The tree stand of claim 2, wherein:

said ornament body comprises a decorative plastic assembly with a generally spherical or cylindrical shape approximately six (6) inches in diameter; and, said flexible tubing comprises a diameter of approximately one-half (½) inch and a length in the range of and including three (3) to five (5) feet.

4. The tree stand of claim 2, wherein said ornament body comprises a decorative plastic assembly with a generally spherical or cylindrical shape.

5. The tree stand of claim 4, wherein said hanging means further comprises a molded hook-shaped appendage.

6. The tree stand of claim 5, wherein said ornament body is approximately six (6) inches in diameter.

7. The tree stand of claim 1, wherein said flexible tubing further comprises a flexible plastic construction tubing;

wherein said flexible tubing is routed therefrom said ornament reservoir therethrough said tree thereto said float valve assembly;

wherein said flexible tubing comprises a plurality of tubing securing means for securing said flexible tubing thereto said tree;

wherein said flexible tubing comprises a lower attachment means thereto said float valve assembly.

8. The tree stand of claim 7, wherein said flexible tubing further comprises a diameter of approximately one-half (½) inch and a length in the range of and including three (3) to five (5) feet.

9. The tree stand of claim 8, wherein said flexible tubing comprises one of the following list: polyethylene, urethane, Tygon®, or rubber.

10. The tree stand of claim 1, wherein said base stand reservoir further comprises:

a tree stand portion, comprising a generally cylindrical reservoir with an upper open end, a side wall portion, and a bottom wall portion; and, a valve assembly portion integrally formed therewith said tree stand portion and housing said float valve;

wherein said base stand reservoir comprises a size large enough to receive both a trunk portion of said tree and said float valve assembly; and, wherein said tree stand portion receives and secures said tree.

11. The tree stand of claim 1, wherein said base stand reservoir further comprises:

a plurality of clamp bolts equidistantly spaced thereabout an upper side wall portion thereof;

a plurality of footpads equidistantly located thereon a bottom surface thereof said bottom wall portion thereof said base stand reservoir; and, a center stabilizing spike protruding outwardly therefrom a center interior surface thereof said tree stand portion thereof said base stand reservoir;

wherein said plurality of clamp bolts provides a tree stability means thereto said tree;

wherein said center stabilizing spike provides an erect stabilizing means thereto said tree.

12. The tree stand of claim 11, wherein said plurality of footpads further comprise three (3) outwardly angled leg structures comprising integral circular horizontal feet designed to establish a secure platform, thereby providing vertical stability thereto said tree secured thereby said tree stand.

13. The tree stand of claim 1, wherein said tree is a Christmas tree.

14. A tree stand comprising an irrigation means and a securing means thereto a tree, further comprising:

an ornament reservoir removably attachable thereto a upper portion of a tree, further comprising:

an ornament body comprising an ornament interior;

a top located reservoir orifice in fluid communication therewith a top portion of said ornament interior;

an ornament lid hingedly attached thereto said ornament body therewith an ornament lid hinge at a rear top surface of said ornament body and providing access thereto said ornament interior;

a molded hook-shaped appendage located adjacent thereto said ornament lid hinge; and, an ornament hose fitting in fluid communication therewith a bottom portion of said ornament interior and located along a bottom surface of said ornament body, comprising a water-tight upper attachment means thereto said flexible hose;

flexible tubing in fluid communication therewith said ornament reservoir, wherein said flexible tubing is routed therefrom said ornament reservoir therethrough said tree thereto said float valve assembly;

a plurality of tubing securing means for securing said flexible tubing thereto said tree;

a float valve assembly in fluid communication therewith said flexible tube and attachable therewith a lower attachment means; and, a base stand reservoir in fluid communication therewith said float valve assembly and housing said float valve assembly, further comprising:

a tree stand portion, comprising a generally cylindrical reservoir with an upper open end, a side wall portion, and a bottom wall portion;

a valve assembly portion integrally formed therewith said tree stand portion and housing said float valve assembly;

a plurality of clamp bolts equidistantly spaced thereabout an upper side wall portion thereof providing a tree stability means thereto said tree;

a plurality of footpads equidistantly located thereon a bottom surface thereof said bottom wall portion thereof said base stand reservoir, comprising integral circular horizontal feet designed to establish a secure platform and providing vertical stability thereto said tree; and, a center stabilizing spike protruding outwardly therefrom a center interior surface thereof said tree stand portion thereof said base stand reservoir, providing an erect stabilizing means thereto said tree;

wherein said base stand reservoir provides a securing means thereto said tree;

wherein said irrigation means provides an access of water thereto said tree;

wherein said ornament reservoir collects an amount of water and directs it therethrough said flexible tubing thereto said base stand reservoir;

wherein said float valve assembly provides a control of a water level to prevent overflowing; and, wherein said irrigation means is particularly useful for users who have difficulty reaching said tree.

15. The tree stand of claim 14, wherein said float valve assembly further comprises:

a valve housing comprising a float valve function via an internal float in fluid communication therewith said base stand reservoir;

a standpipe extending vertically therefrom said valve housing and in fluid communication therewith and attachable thereto said flexible tubing and said internal float valve; and, a valve assembly portion lid removably attachable thereto an upper perimeter edge thereof said valve assembly portion thereof said base stand reservoir to provide a partial cover and a lid attachment means therefore;

wherein said internal float valve provides said control for said water level;

wherein said valve assembly portion lid overlaps said upper perimeter edge thereof said valve assembly portion;

wherein said valve assembly portion lid permits the passage thereof said standpipe;

wherein said valve assembly portion lid provides access thereto said float valve assembly.

16. The method of installing a system for securing and irrigating a tree supported by a tree stand comprises the following steps:

providing said system, further comprising:

an ornament reservoir removably attachable thereto a upper portion of a tree, further comprising:

an ornament body comprising an ornament interior;

a top located reservoir orifice in fluid communication therewith a top portion of said ornament interior;

an ornament lid hingedly attached thereto said ornament body therewith an ornament lid hinge at a rear top surface of said ornament body and providing access thereto said ornament interior;

a molded hook-shaped appendage located adjacent thereto said ornament lid hinge; and, an ornament hose fitting in fluid communication therewith a bottom portion of said ornament interior and located along a bottom surface of said ornament body, comprising a water-tight upper attachment means thereto said flexible hose;

flexible tubing in fluid communication therewith said ornament reservoir, wherein said flexible tubing is routed therefrom said ornament reservoir therethrough said tree thereto said float valve assembly;

a plurality of tubing securing means for securing said flexible tubing thereto said tree;

a float valve assembly in fluid communication therewith said flexible tube and attachable therewith a lower attachment means, further comprising:

a valve housing comprising a float valve function via an internal float in fluid communication therewith a base stand reservoir;

a standpipe extending vertically therefrom said valve housing and in fluid communication therewith and attachable thereto said flexible tubing and said internal float valve; and, a valve assembly portion lid removably attachable thereto an upper perimeter edge thereof a valve assembly portion thereof said base stand reservoir to provide a partial cover and a lid attachment means therefore; and, said base stand reservoir in fluid communication therewith said float valve assembly and housing said float valve assembly, further comprising:

a tree stand portion, comprising a generally cylindrical reservoir with an upper open end, a side wall portion, and a bottom wall portion;

said valve assembly portion integrally formed therewith said tree stand portion and housing said float valve assembly;

a plurality of clamp bolts equidistantly spaced thereabout an upper side wall portion thereof providing a tree stability means thereto said tree;

a plurality of footpads equidistantly located thereon a bottom surface thereof said bottom wall portion thereof said base stand reservoir, comprising integral circular horizontal feet designed to establish a secure platform and providing vertical stability thereto said tree; and, a center stabilizing spike protruding outwardly therefrom a center interior surface thereof said tree stand portion thereof said base stand reservoir, providing an erect stabilizing means thereto said tree;

placing said base stand reservoir thereupon a flat surface;

adjusting said plurality of clamp bolts outwardly by turning in a counter-clockwise direction, thereby maximizing said upper open end thereof said tree stand portion thereof said base stand reservoir;

inserting said tree thereinto said upper open end thereof said tree stand portion therebetween said plurality of clamp bolts and being secured thereon said center stabilizing spike anchor;

tightening said plurality of clamp bolts in alternating succession until said tree is securely erect and stationary;

routing said flexible tubing thereinto a foliage portion of said tree starting at an external location where an eventual position for said ornament reservoir is desired;

routing said flexible tubing such that a plain end of said flexible tubing is directed inwardly toward a tree trunk thereat a downward slope, thereby assuring proper drainage;

attaching said flexible tubing thereto said tree using a plurality of tubing securing means as needed;

attaching said flexible tubing thereto a top opening portion of said standpipe utilizing said lower attachment means;

attaching said flexible tubing thereto said ornament hose fitting thereof said ornament reservoir utilizing said upper attachment means;

affixing said ornament reservoir securely thereto at least one (1) external branches of said tree using said hook-shaped appendage;

opening said ornament lid, thereby providing access thereto said top located ornament orifice;

pouring a volume of water thereinto said ornament reservoir through said top located reservoir orifice, wherein said volume of water produces a water flow therethrough said ornament reservoir, said flexible tubing, said standpipe, and said float valve assembly thereto said base stand reservoir;

continuing to add water until a water level therein said base stand reservoir forces said internal float of said float valve assembly to seal off said water flow;

pouring an additional volume of water therein said ornament reservoir periodically as required, due to evaporation and consumption of water therefrom said base stand reservoir;

accessing said float valve assembly thereby removing said valve assembly portion lid therefrom said valve assembly portion thereof said base stand reservoir, as needed;

removing said system after use therefrom said tree by removing said plurality of tubing securing means;

disconnecting and removing said flexible hose;

disconnecting and removing said ornament reservoir therefrom said tree; and, storing said system until subsequent use.

* * * * *